US005747151A

United States Patent [19]

Tingley

[11] Patent Number: 5,747,151

[45] Date of Patent: May 5, 1998

[54] GLUE-LAMINATED WOOD STRUCTURAL MEMBER WITH SACRIFICIAL EDGES

[76] Inventor: Daniel A. Tingley, 3310 SW. Willamette Ave., Corvallis, Oreg. 97333

[21] Appl. No.: 647,181

[22] Filed: May 9, 1996

Related U.S. Application Data

[60] Provisional application No. 60/013,278, Mar. 12, 1996, and a continuation-in-part of PCT/US95/09204, Jul. 21, 1995.

[51] Int. Cl.[6] ..... E04C 3/12; E04C 3/18

[52] U.S. Cl. ..... 428/299.1; 144/345; 144/350; 428/114; 428/297.4; 428/298.1; 428/299.1; 428/299.7

[58] Field of Search ..... 156/154; 144/350, 144/345; 428/300.4, 297.4, 298.1, 299.1, 299.4, 114, 192, 299.7; 52/309.14

[56] References Cited

U.S. PATENT DOCUMENTS 5,026,593 6/1991 O'Brien .
5,362,545 11/1994 Tingley .
5,456,781 10/1995 Tingley .

FOREIGN PATENT DOCUMENTS 224050 2/1990 New Zealand .

OTHER PUBLICATIONS

Composite News: Infrastructure, (16 Aug. 1995) No. 30, "Creative Pultrusions Makes Glulam Reinforcements All E–Glass Fiber Used With Phenolic Resin".

Gardner, D.J., et al "Adhesive bonding of pultruded Fiber–reinforced plastic to wood," Forest Products Journal, (May 1994), vol. 44, no. 5, pp. 62–66.

Composite News: Infrastrucure, (16 Aug. 1995) No. 30 "Awsome Fiber Demand Seen For Glulams."

*Primary Examiner*—Jeff H. Aftergut
*Attorney, Agent, or Firm*—Stoel Rives LLP

[57] ABSTRACT

A method of manufacturing a glue laminated structural wood member (10) for bearing a structural load (16) includes bonding together multiple elongate wood segments (12) and a synthetic fiber reinforcement (24, 30) with their lengths generally aligned with the length of the member. The synthetic fiber reinforcement includes multiple synthetic fiber strands (52, 54) held within a resin matrix (56) and low cost fiber edges.

4 Claims, 2 Drawing Sheets

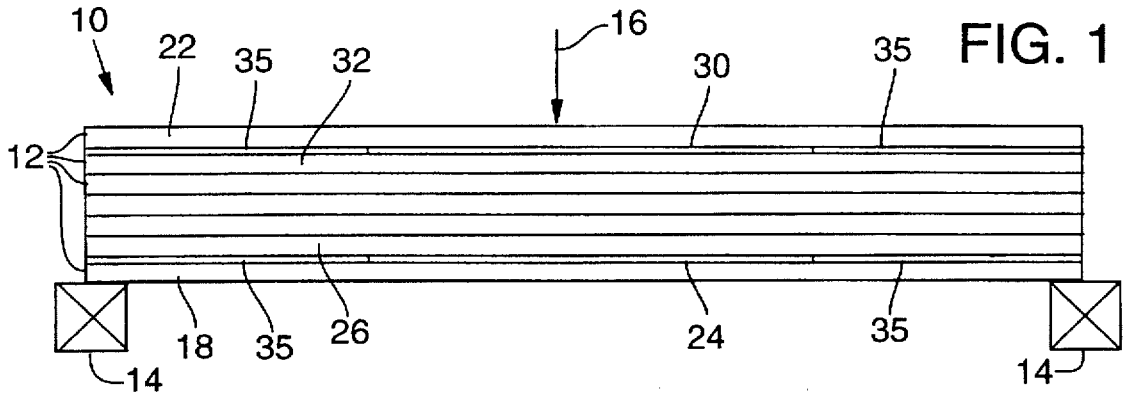
FIG. 1
FIG. 2
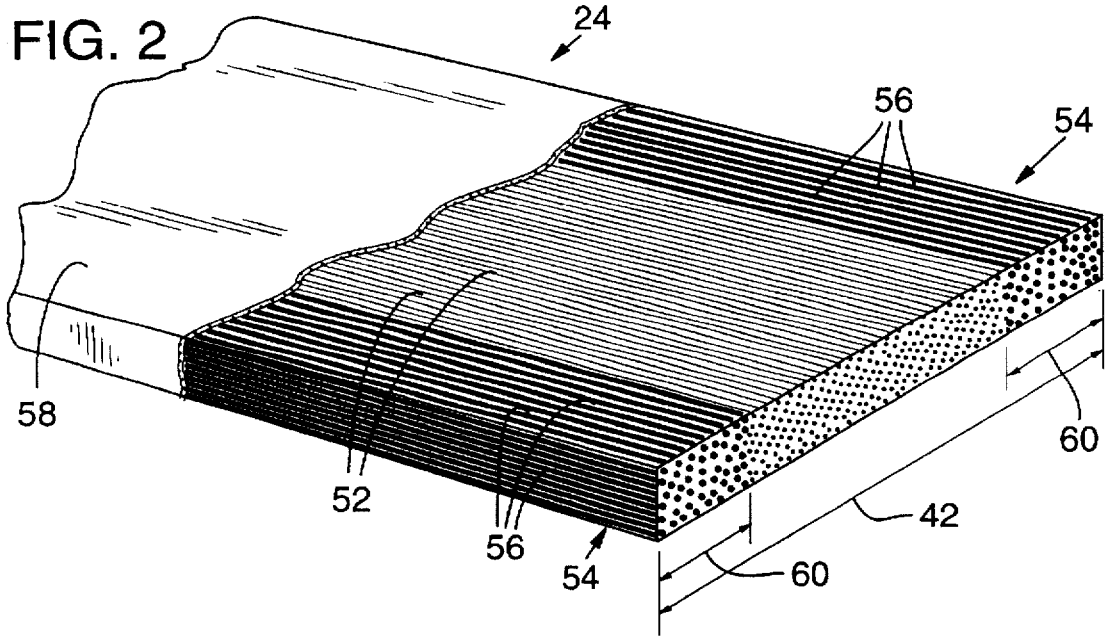
FIG. 3
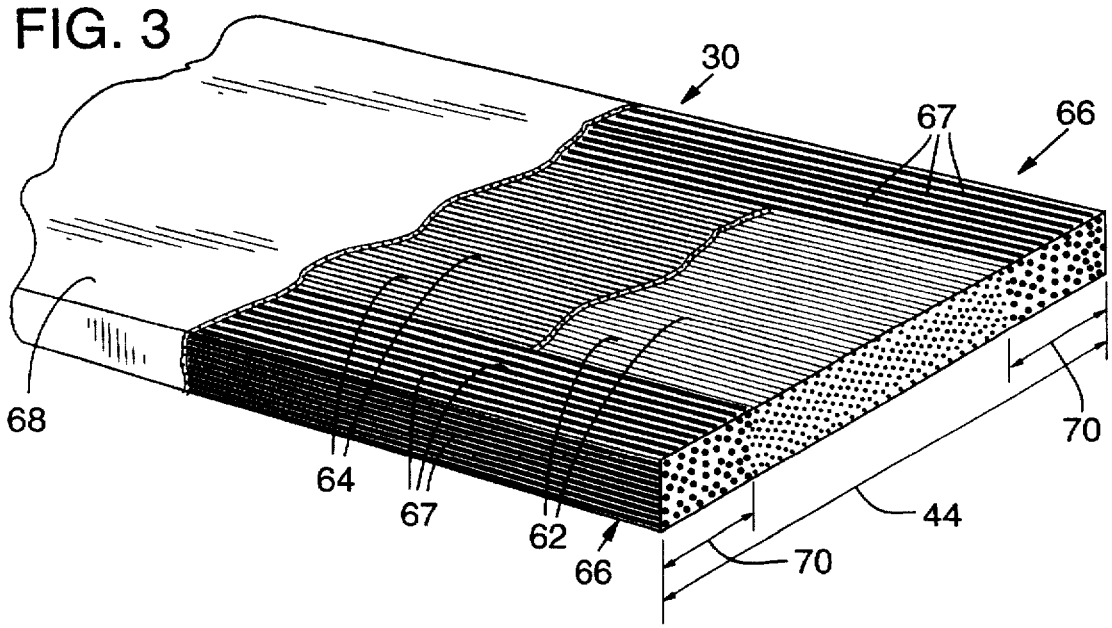

GLUE-LAMINATED WOOD STRUCTURAL MEMBER WITH SACRIFICIAL EDGES

This application claims benefit of provisional application Ser. No. 60/013,278, filed Mar. 12, 1996, and is a continuation-in-part of PCT Patent Application No. PCT/US95/09204, filed Jul. 21, 1995.

FIELD OF THE INVENTION

The present invention relates to wood structural members and, in particular, to methods of manufacturing glue laminated wood structural members.

BACKGROUND OF THE INVENTION

Beams, trusses, joists, and columns are the typical structural members that support the weight or loads of structures, including buildings and bridges. Structural members may be manufactured from a variety of materials, including steel, concrete, and wood, according to the structure design, environment, and cost.

Wood structural members are now typically manufactured from multiple wood segments that are bonded together, such as in glue-laminated members, laminated veneer lumber and I-beams. They can also be manufactured with wood fibers in a polymer matrix such as parallel strand timber or orientated strand board. These manufactured wood structural members have replaced sawn lumber or timbers because the former have higher design limits resulting from better inspection and manufacturing controls. Wood is a desirable material for use in many structural members because of its various characteristics, including strength for a given weight, appearance, cyclic load response, and fire resistance.

In any application, a load subjects a structural member to both compressive and tensile stresses, which correspond to the respective compacting and elongating forces induced by the load on opposite sides of the member. By convention, a neutral plane or axis extends between the portions of the member under compression and tension. The structural member must be capable of bearing the compressive and tensile stresses without excessive strain and particularly without ultimately failing.

Reinforcement of wood structural members in regions subjected to tensile stresses are known. For example, U.S. Pat. No. 5,026,593 of O'Brien describes the use of a thin flat aluminum strip to reinforce a laminated beam. The use of a synthetic tension reinforcement having multiple aramid fiber strands held within a resin matrix adhered to at least one of the wood segments in the tension portion of the structural member is described by the inventor of the present application in "Reinforced Glued-Laminated Wood Beams" presented at the 1988 International Conference on Timber Engineering.

U.S. Pat. Nos. 5,362,545 and 5,456,781 of Tingley describe methods of adhering the reinforcement to wood using conventional non-epoxy adhesives.

Manufacture of the above-mentioned reinforced structural members results in a significant amount of waste of the relatively expensive synthetic reinforcement material. This waste is generally the result of the planing process to produce a finished edge. Additionally, planing the synthetic reinforcement fiber strands causes significant wear on the cutting tools. Therefore, a need exists for a method of producing structural wood members with synthetic reinforcements without significant waste of the synthetic reinforcement material. Furthermore, a need exists for a method of producing a finished edge on a structural wood member without significant wear of the cutting tools.

SUMMARY OF THE INVENTION

An object of the present invention is, therefore, to provide a method of manufacturing reinforced wood structural members with synthetic fiber reinforcement.

Another object of this invention is to provide such a method that allows efficient application of a synthetic reinforcement to wood structural members.

Still another object of this invention is to provide such a method that provides a synthetic reinforcement with low cost fiber edges.

A further object of this invention is to provide such a method that prevents waste of high strength synthetic reinforcement.

Yet another object of this invention is to provide such a method that reduces wear of the cutting tools.

In a preferred embodiment, the present invention includes a method of manufacturing glue laminated wood structural members in which multiple elongate wood segments and at least one synthetic fiber reinforcement are bonded together with their lengths generally aligned. However, the method would apply to all forms of wood and wood composites from solid wood to plywood to parallel strand lumber. The synthetic fiber reinforcement includes multiple synthetic fiber strands having a high modulus of elasticity in tension and/or compression held within a resin matrix. These fiber strands are relatively high in cost. The edges of the reinforcement are formed from low cost fibers made of material such as hemp, cotton or polyester. The assembled wood member has a width formed by the rough edges of the laminae. The synthetic fiber reinforcement is formed with a width that is substantially matched to the rough width of the wood member. The rough edges are then planed to form a finished width. Only the low cost fiber edges of the reinforcement are planed away avoiding waste of the high cost synthetic fiber strands. Additionally, the low cost fiber edges cause less wear on the cutting tools. Therefore, the low cost fiber edges substantially reduce cost, reduce machinery wear, and improve overall manufacturing ease.

Additional objects and advantages of this invention will be apparent from the following detailed description of preferred embodiments thereof which proceeds with reference to the accompanying drawings.

BRIEF DESCRIPTION OF THE DRAWINGS

FIG. 1 is an elevation view of an exemplary glue laminated structural wood member having a synthetic fiber reinforcement according to the present invention.

FIG. 2 is a perspective view of a section of synthetic tension reinforcement with portions cut away to show the alignment and orientation of the fibers.

FIG. 3 is a perspective view of a section of synthetic compression reinforcement with portions cut away to show the alignment and orientation of the fibers.

DETAILED DESCRIPTION OF PREFERRED EMBODIMENTS

Figure 4:
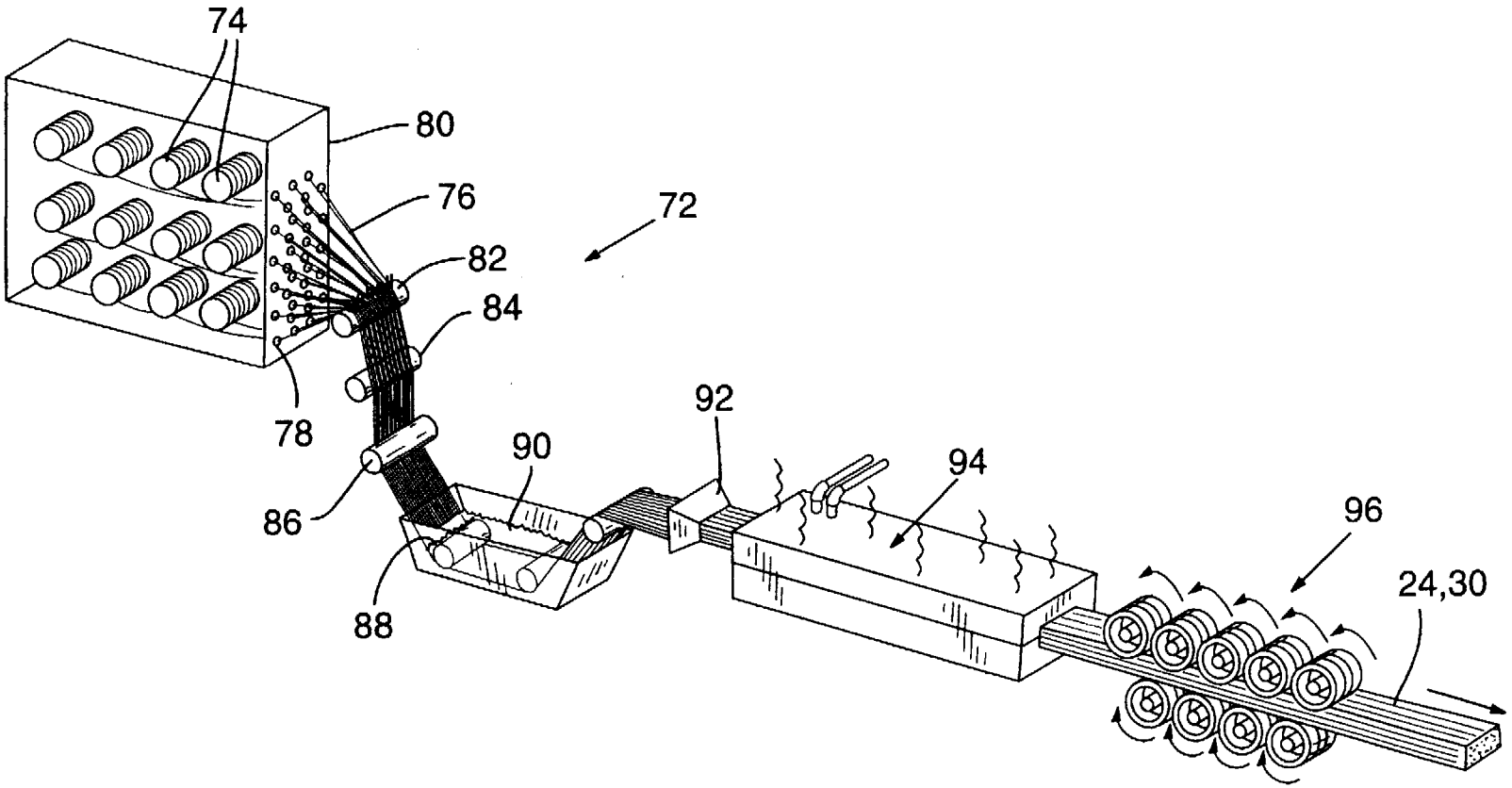
FIG. 4 is a perspective view of a pultrusion apparatus for producing an elongate synthetic reinforcement of the present invention.

FIG. 1 shows a glulam wood structural member 10 having multiple wood laminae 12 that are bonded together and are preferably elongate boards. In this configuration, glue laminated wood member 10 is configured as a glue-laminated timber according to manufacturing standards 117–93 of the American Institute of Timber Construction (AITC) of Englewood, CO.

A typical structural use of glue laminated wood member 10 is to extend as a beam over and bear a load along an otherwise open region. As a simplified, exemplary representation of such use, glue laminated wood member 10 is shown with its ends supported by a pair of blocks 14 and bearing a point load 16 midway between blocks 14. It will be appreciated, however, that glue laminated wood member 10 of the present invention could also bear loads distributed in other ways (e.g., cantilevered) or be used as a truss, joist, or column.

Under the conditions represented in FIG. 1, a lowermost lamina 20 is subjected to a substantially pure tensile stress, and an uppermost lamina 22 is subjected to a substantially pure compressive stress. To increase the tensile load-bearing capacity of glue laminated wood member 10, at least one layer of synthetic tension reinforcement 24 is adhered between lowermost lamina 20 and a next adjacent lamina 26 or, alternatively, to only an outer surface 28 of lowermost lamina 20. To increase the compressive load-bearing capacity of glue laminated wood member 10, at least one layer of synthetic compression reinforcement 30 is adhered between uppermost lamina 22 and a next adjacent lamina 32 or, alternatively, to only the outer surface 34 of uppermost lamina 22. Synthetic reinforcements 24 and 30 are described below in greater detail.

Synthetic tension reinforcement 24 and synthetic compression reinforcement 30 are generally centered about load 16 and preferably extend along about two-fifths to three-fifths the length of wood structural member 10, depending on load 16. It can also extend the full length of the wood structural member 10. A pair of wood spacers 35 are positioned at opposite ends of synthetic tension reinforcement 24 between laminae 20 and 26 to maintain a uniform separation therebetween. Similarly, a pair of wood spacers 35 are positioned at opposite ends of synthetic compression reinforcement 30 between laminae 22 and 32 to maintain a uniform separation therebetween.

General aspects of the process for manufacturing of glue laminated structural wood member 10 are the same as the process for manufacturing conventional glue laminated structural wood members. With regard to the manufacture of conventional glue laminated structural wood members, wood laminae are carried by a conveyor through a glue spreader, which applies multiple thin streams of adhesive (e.g., resorcinol) along the length of each wood lamina on one of its major surfaces.

Wood laminae are successively aligned with and set against other wood laminae in a stack that may be oriented horizontally or vertically. The wood laminae are arranged so that the adhesive on the major surface of one wood lamina engages the bare major surface of an adjacent wood lamina. After all the wood laminae are aligned with and set against each other, pressure in the range of about 125–250 psi is applied to the stack and the adhesive allowed to cure. As is known in the art, sufficient pressure is applied to establish consistent gluelines between adjacent wood laminae 12 of no more than 4 mils (0.10 mm) thick. The edges of the adhered stack of wood laminae 12 are then planed to a finished width so that the sides of all wood laminae 12 are exposed to form a conventional glue laminated structural wood member. This function can be performed by sawing as well.

In a first preferred embodiment, synthetic fiber reinforcements 24 and 30 are carried through a conventional glue spreader (not shown), which applies multiple thin streams of adhesive (e.g., resorcinol) along the length of each reinforcement 24 or 30 on one of its major surfaces. Adhesion between wood laminae 12 and reinforcements 24 or 30 can be relatively poor when using a nonepoxy adhesive such as resorcinol applied in the conventional manner. Adhesion is improved, however, when the adhesive is spread to generally completely cover the major surfaces of synthetic fiber reinforcements 24 and 30. Alternate adhesives are also satisfactory, such as, for example, epoxy adhesives.

It will be appreciated that such spreading of the adhesive can be accomplished by spreading the adhesive applied to one of the major surfaces of synthetic fiber reinforcements 24 and 30 or by spreading the adhesive applied to one of the major surfaces of a wood lamina to be applied to one of synthetic fiber reinforcements 24 and 30. The spreading of adhesive may be accomplished, for example, by manually spreading the adhesive before synthetic fiber reinforcements 24 and 30 and adjacent wood laminae 12 are engaged or by engaging them and sliding them against each other before the adhesive sets.

During manufacture of the wood member 10, different wood laminae 12 are successively set against each other with synthetic fiber reinforcements 24 and 30 positioned as desired to form a stack. The stack may be oriented horizontally or vertically so that the sides of adjacent wood laminae and synthetic reinforcements are aligned. Since the laminae 12 and the reinforcements 24 and 30 have substantially the same widths it is not necessary to secure reinforcements 24 and 30 to the stack with pin nails or banding as in previous reinforced wood members. Thus, the time and expense of assembling the stack is reduced.

Preferrably, synthetic fiber reinforcements 24 and 30 are manufactured with respective rough widths 42 and 44 (FIGS. 2 and 3) that are substantially matched to the rough width of wood member 10 (extending into the plane of FIG. 1). Thus, the widths 42 and 44 of synthetic fiber reinforcements 24 and 30 have substantially the same original width as the wood laminae 12 used to form wood member 10. The original widths of wood laminae 12 used to form wood member 10 can vary so long as they are greater than the finished width of wood member 10. The original reinforcement width can be the average of these rough widths or whatever is suitable for conditions.

FIG. 2 is an enlarged perspective view of a preferred synthetic tension reinforcement 24. The tension reinforcement 24 has a large number of synthetic fibers 52 that are arranged substantially parallel to one another and parallel to the longitudinal axis of the reinforcement 24. The fibers 52 have a relatively high moduli of elasticity in tension and may be made of, for example, an aramid or high performance polyethylene or fiberglass, having a modulus of elasticity in tension in a range of about $10\times10^6$ psi (69,000 Mpa) to about $33\times10^6$ psi (230,000 Mpa). These fibers 52 are generally high cost fibers and it is desirable to prevent waste of these fibers during planing of the wood member 10 to form finished edges.

In order to prevent planing away of the high cost fibers 52 the edges 54 of the tension reinforcement 24 are formed from low cost cotton, hemp, and/or polyester fibers 56. For illustration purposes, the fibers 56 are shown as having a slightly larger diameter than the fibers 52. However, it is to be understood that the diameters of fibers 56 and 52 may or may not be the same. Only the outer longitudinal edges 54 are formed of the low cost fibers 56. These fibers 56 fill out the die or pack out the reinforcement profile during the pultrusion process to maintain packing fiber matrix volume ratios, alignment, and prevention of fiber crossover or roll-over when the reinforcement is produced.

A resin material 58 surrounds and extends into the interstices between the low cost fibers 56 and the high cost fibers 52 to maintain them in their arrangement and alignment. The fiber/resin volume ratio of the reinforcement 24 is within a range of about 60 percent fibers/40 percent resin to about 83 percent fibers/ 17 to 40 percent resin. The reinforcement 24 has a composite modulus of elasticity in tension in a range of about $6\times10^6$ psi (41,000 Mpa) to about $20\times10^6$ psi (138,000 Mpa). To facilitate adhesion to the wood laminae 12, the reinforcement 24 is preferably manufactured and treated as described in U.S. Pat. No. 5,362,545 so that material from the fibers closest to a major surface of the reinforcement protrude from the resin. This may be done by abrading the surface with an abrasive in a direction transverse to the longitudinal direction of the reinforcement. Alternatively, the surface may be subject to a chemical treatment prior to curing the resin causing voids in the surface which remove portions of the resin and exposes the fibers. Other methods of surface treatment may include the use of broken rovings which protrude from the resin after curing or the use of an epoxy-type of adhesive to achieve sufficient bond strength.

The original or rough edges of the wood member 10 are then planed to produce a finished edge using a high speed cutting tool. Prior synthetic reinforcments are generally formed of one or two types of high cost synthetic fibers, such as, for example, fibers 52. When the reinforcement is planed to form finished edges, the fibers are cut away and wasted. Since these fibers are generally costly, it is desirable to plane away as little of this material as possible. Preferably, none of the high cost fiber material is planed away. Additionally, such fibers cause machinery wear which further increases cost and decreases efficiency.

When the wood structural member 10 is formed the edges are planed to the finished width. The majority of material planed away is from the low cost fiber edges of the reinforcements 24 and 30. The amount of material removed from each edge of the wood member 10 during planing is generally in the range of about .125 inches to about .5 inches. Therefore, each edge 54 preferably has a width 60within this range. As a result, planing away of the high cost synthetic fibers 52 is avoided. Additionally, the modulus of elasticity of the low cost fibers 56 is generally less than 500,000 psi (3450 Mpa). The fibers 56 are readily machinable with conventional cutting tools, such as, for example, high speed steel planer knives. Forming the edges 54 with the low cost fibers 56 helps prevent waste of the high cost fibers 52, reduces machinery wear, and increases manufacturing effectiveness.

FIG. 3 is an enlarged perspective view of a preferred synthetic compression reinforcement 30. The compression reinforcement 30 has a large number of synthetic fibers 62 that are arranged substantially parallel to one another and to the longitudinal axis of the reinforcement 30. These fibers may be commercially available carbon and fiberglass fibers, which have a modulus of elasticity in compression in the range of about $34\times10^6$ to $36\times10^6$ psi (234,000–248,000 MPa). The reinforcement 30 is manufactured substantially the same as reinforcement 24 but may include a combination of additional fibers 64 of aramid or high performance polyethylene. The fibers 62 and 64 may be layered or comingled. The edges 66 of reinforcement 30 are formed of low cost fibers 67 similar to fibers 56 in reinforcement 24. Resin 68 extends between the interstices of the fibers 62, 64 and 67 to maintain alignment of the fibers. The edges 66 have a width 70 in the range of about .125 inches to about .5 inches. Synthetic compression reinforcement 30 has a fiber/resin volume ratio within a range of about 60 percent fibers/40 percent resin to about 83 percent fibers/17 percent resin. The reinforcement 30 has a modulus of elasticity in compression in the range of about $18\times10^6$ to $19\times10^6$ psi (124,000–131,000 MPa).

The resin material 58 and 68 used in fabrication of both reinforcement 24 and reinforcement 30 is preferably an epoxy resin, but could alternatively be other resins such as polyester, vinyl ester, phenolic resins, polymides, or polystyrylpyridine (PSP) or thermoplastic resins such as polyethylene terephthalate (PET) and nylon-66.

Synthetic fiber reinforcements 24 and 30 may be fabricated by various methods, such as a sheet forming or pull-forming process which. Preferably, the reinforcements 24 and 30 are fabricated by pultrusion, which is a continuous manufacturing process for producing lengths of fiber reinforced plastic parts. Generally, pultrusion involves pulling flexible reinforcing fibers through a liquid resin bath and then through a heated die where the reinforced plastic is shaped and the resin is cured. Pultruded parts typically have longitudinally aligned fibers for axial strength and obliquely aligned fibers for transverse strength. In accordance with the present invention, however, preferred reinforcements 24 and 30 are manufactured with substantially all respective fibers in a parallel arrangement and longitudinal alignment to provide maximal strength. In some circumstances, such as to enhance shear resistance in reinforcements 24 and 30, less than substantially all of respective fibers 52 and 62 would be in a parallel arrangement and longitudinal alignment.

FIG. 4 shows a preferred pultrusion apparatus 72 for fabricating synthetic fiber reinforcements 24 and 30. Multiple bobbins 74 carry synthetic fiber rovings 76. As is known in the art, filaments are grouped together into strands or fibers, which may be grouped together into twisted strands to form yarn, or untwisted strands to form rovings. Rovings 76 are fed through openings 78 in an alignment card 80 that aligns that rovings 76 and prevents them from entangling. Openings 78 are typically gasketed with a low friction material, such as a ceramic or plastic, to minimize abrasion of or resistance to rovings 76.

In the fabrication of the reinforcements 24 and 30, it is understood that the bobbins 74 containing different fibers are constructed and arranged so that as the various fibers exit the card 80 they are arranged to form the reinforcement profiles as shown in FIGS. 2 and 3.

Rovings 76 pass from card 80 to a first comb 82 that gathers them and arranges them parallel to one another. Rovings 76 then pass over a tensioning mandrel 84 and under a second alignment comb 86. They pass through close-fitting eyelets 88 directly into a resin bath 90 where they are thoroughly wetted with resin material. Passing rovings 76 into resin bath 90 through eyelets 88 minimizes the waste of rovings 76 whenever the pultrusion apparatus 72 is stopped. Resin-wetted rovings 76 are gathered by a forming die 92 and passed through a heated die 94 that cures the resin material and shapes the rovings 76 into reinforcements 24 and 30. Multiple drive rollers 96 pull the reinforcements 24 and 30 and rovings 76 through pultrusion apparatus 72 at a preferred rate of 3–5 feet/minute (0.9–1.5 m/minute).

To minimize waste and simplify handling and use, the reinforcements 24 and 30 are formed so as to be wound onto a reel (not shown) so that arbitrary lengths can be drawn and cut for use. The reinforcements 24 and 30 are formed with relatively small thicknesses of about 0.25 cm to about 6.4 cm (0.010 in. –0.0250 in.) and can be wound onto reels having a diameter in the range of about 99 cm to about 183 cm (39 in.–72 in.).

Pultrusion apparatus 72 is capable of forming synthetic reinforcements 24 and 30 without longitudinal cracks or faults extending through and with cross-sectional void ratios of no more than 5 percent. Cross-sectional void ratios refer to the percentage of a cross-sectional area of synthetic reinforcements 24 and 4 30 between respective fibers 52 and 62, typically occupied by resin material, and is measured by scanning electron microscopy. The absence of faults and the low void ratios assure that synthetic reinforcements 24 and 30 are of maximal strength and integrity.

The preferred resin materials, as described above and applied to rovings 76, have a glass transition temperature within a range of 250–300° F. Glass transition is an indicator of resin flexibility and is characterized as the temperature at which the resin loses its hardness or brittleness, becomes more flexible, and takes on rubbery or leathery properties. A glass transition temperature within the preferred range is desirable because it provides a minimal fire resistance temperature. The preferred cure rate of the resin material, which is the amount of material that cures from a monomer structure to a polymer structure, is 78 to 82 percent. It has been determined that synthetic reinforcements 24 and 30 with cure rates within this range have higher shear stress bearing capabilities at interfaces with both synthetic reinforcements and wood laminae.

Preferably, a fiber tension force in the range of about three to eight pounds is applied to rovings 76 during the resin cure. The fiber tension force may be applied as a back pressure by tensioning mandrel 84 in combination with combs 82 and 86 or by the use of friction bobbins 74, wherein rotational friction of the bobbins may be adjusted to provide the desired back pressure on rovings 76. Such tension in the fibers assists in maintaining their parallel arrangement and alignment in reinforcements 24 and 30. Also, by curing the resin material while the fibers are under tension, reinforcements 24 and 30 have greater rigidity and therefore decrease deflection of wood member 10 upon loading. It will be obvious to those having skill in the art that many changes may be made to the details of the above-described embodiment of this invention without departing from the underlying principles thereof. The scope of the present invention should be determined, therefore, only by the following claims.

I claim:

1. A laminated wood structural load bearing member having a longitudinal axis, comprising:

plural elongate wood laminae each of which has a length and two major surfaces, multiple synthetic reinforcements each having a length and two major surfaces formed of plural fiber strands held within a resin matrix, each synthetic reinforcement having a central portion formed only of a first material, the central portion having a top surface and a bottom surface forming the major surfaces of the synthetic reinforcement, and at least one outer longitudinal edge formed only of plural fiber strands of a second material, at least one major surface of each synthetic reinforcement being secured by nonepoxy bonding to a major surface of one of the wood laminae.

2. The member of claim 1 in which the fiber strands of a first material are selected from a group consisting essentially of carbon, aramid, and high modulus polyethylene.

3. The member of claim 1 in which the fiber strands of a second material are selected from a group consisting essentially of cotten, hemp, and polyester.

4. The member of claim 3 in which the outer longitudinal edges of the reinforcements have a width generally in the range of about .125 inches to about .5 inches.

* * * * *